US005365767A

United States Patent [19]

Kitchen et al.

[11] Patent Number: 5,365,767

[45] Date of Patent: Nov. 22, 1994

[54] BRAKE PRESS ARRANGEMENT

[75] Inventors: William A. Kitchen, Grand Rapids; Malcolm F. Hitchcock, Caledonia, both of Mich.

[73] Assignee: Steelcase Inc., Grand Rapids, Mich.

[21] Appl. No.: 856,171

[22] Filed: Mar. 23, 1992

[51] Int. Cl.[5] ..... B21D 37/04; B21D 37/12

[52] U.S. Cl. ..... 72/481; 72/446; 72/456; 72/389

[58] Field of Search ..... 72/481, 389, 446, 448, 72/455, 456

[56] References Cited

U.S. PATENT DOCUMENTS

| | | | |
|---|---|---|---|
| 851,350 | 4/1907 | Frey . | |
| 1,839,370 | 1/1932 | Borton . | |
| 1,852,101 | 4/1932 | Baker . | |
| 1,863,729 | 6/1932 | Rafter . | |
| 2,009,660 | 7/1935 | Irmis . | |
| 2,421,457 | 6/1947 | Lindsay . | |
| 2,669,276 | 2/1954 | Humphrey . | |
| 3,212,430 | 10/1965 | Clements . | |
| 3,214,955 | 11/1965 | Voth . | |
| 3,303,558 | 2/1967 | Horlacher et al. . | |
| 3,516,277 | 6/1970 | Bracco et al. . | |
| 3,559,522 | 2/1971 | Kankakee, III . | |
| 3,702,558 | 11/1972 | Swenson et al. . | |
| 3,782,166 | 1/1974 | Whistler, Jr. et al. . | |
| 3,834,217 | 9/1974 | Ducate . | |
| 3,848,494 | 11/1974 | Gargrave et al. . | |
| 3,880,038 | 4/1975 | Mangos . | |
| 3,881,343 | 5/1975 | Ducate . | |
| 3,908,500 | 9/1975 | Gargrave et al. . | |
| 4,112,731 | 9/1978 | Anderson et al. . | |
| 4,151,736 | 5/1979 | Quaas | 72/446 |
| 4,170,890 | 10/1979 | Kojima . | |
| 4,188,815 | 2/1980 | Mizushima . | |
| 4,258,620 | 3/1981 | Sallander . | |
| 4,555,840 | 12/1985 | Nakamura . | |
| 4,602,497 | 7/1986 | Wallis . | |
| 4,612,796 | 9/1986 | Smyth, Jr. | 72/389 |
| 4,680,955 | 7/1987 | Sakamoto . | |
| 4,698,894 | 10/1987 | Lingaraju et al. . | |
| 4,753,099 | 6/1988 | Klingel . | |
| 4,891,965 | 1/1990 | Piacentini . | |
| 4,966,029 | 10/1990 | Zbornik . | |
| 5,022,256 | 6/1991 | van der Meulen . | |
| 5,121,626 | 6/1992 | Baldwin | 72/481 |

FOREIGN PATENT DOCUMENTS

| | | | |
|---|---|---|---|
| 0057717 | 3/1987 | Japan | 72/446 |
| 0186220 | 7/1989 | Japan | 72/481 |
| 499934 | 6/1974 | U.S.S.R. . | |

OTHER PUBLICATIONS

Article "Bending the Wright Way" in the Aug. 1989 issue of Metal Forming Magazine, pp. 16–25.

*Primary Examiner*—David Jones

*Attorney, Agent, or Firm*—Price, Heneveld, Cooper, DeWitt & Litton

[57] ABSTRACT

An apparatus is provided for prealigning multiple brake dies to facilitate die changes in a brake press. The apparatus comprises a die holder including a floating adapter attachable to the movable ram of the brake press, and a pair of subplates adapted to receive the multiple brake dies in a semipermanent and prealigned arrangement to form a subassembly which can be installed into the die holder with minimum setup time. The floating adapter permits transfer of loads from the press ram to the multiple brake dies in the subassembly without also communicating undesirable bending stresses therethrough. Also, the die holder includes guides for directing the subplates along a true linear path toward and away from each other. Secondary equipment used with the brake dies can be attached directly to the subplates, thus further reducing die change setup time.

22 Claims, 5 Drawing Sheets

BRAKE PRESS ARRANGEMENT

BACKGROUND OF THE INVENTION

The present invention concerns installation and setup of brake dies in a brake press, and in particular an arrangement to facilitate rapid installation and setup of brake dies.

Brake dies are often used in the furniture industry and other like industries where blanks of sheet metal must be bent and formed, such as for forming brackets, drawers, and other like parts. For quality operation, brake dies require a balanced force applied across their entire width with sufficient magnitude so that the opposite die halves bottom out. Absent this action, the die tends to form incomplete and unfinished bends with inconsistent dimensions. However, achieving a balanced load is not easy, and usually the die halves must be custom shimmed and carefully packed so that a sufficiently balanced force is achieved. Further, the presses are often adjusted to transmit a higher load than is actually needed to bend the workpiece, in an attempt to assure that the dies bottom out across their entire width, thus leading to excessive wear and tear on the dies.

A large part of the problem is that each brake press and brake die combination requires a customized setup. Even repeat setups in a given press require a degree of customization due to variations and wear in the press, dies, and raw material being formed. This is further complicated by use of multiple brake dies arranged side-by-side in a given brake press, which is often done to improve press utilization and productivity. Still further, setup of dies on the production floor can be a difficult environment to maximize the quality of the setup and maximize the efficient use of die tryout personnel and tools. Also, brake presses often close non-uniformly as a result of press bearing wear or misadjustment, leading to non-uniform die wear, uneven or inconsistent clamping forces on the dies, and difficult die setup. The net result is a lengthy and labor intensive die setup that requires customized shimming and involves a considerable amount of production press downtime.

Thus, an arrangement is desired which will provide a consistent and quality setup of brake dies, along with improved installation time and reduced manual labor. Further, it is desirable to achieve this result without sizable capital investment, and in a manner that is compatible with existing brake presses and brake dies.

SUMMARY OF THE INVENTION

The present invention includes an apparatus for prealigning multiple brake dies to facilitate die changes in a brake press having a ram. The apparatus includes a die holder having a floating adapter to minimize undesirable bending stresses on the die holder from misaligned and nonlinear movement of the ram of the brake press, and further includes a pair of subplates adapted to receive multiple brake dies in a semipermanent arrangement to form a subassembly wherein the multiple brake dies can be prealigned, the subplates being adapted to mateably removably engage the die holder. The die holder further includes guides for guiding the subplates along a linear path toward and away from each other. With this arrangement, the multiple brake dies can be semipermanently attached to the subplates, the die holder can be semipermanently attached to the brake press, and the subassembly can be removably installed in the die holder and in the brake press in a time efficient manner.

The present invention offers several advantages over known systems. The invention includes a die holder adapted for use with existing brake presses without major redesign or refurbishing of the brake presses or brake dies. Further, the die holder includes guides that direct the brake die halves closed along a linearly accurate path, thus minimizing undesired bending stresses on the brake dies while improving both the initial die setup as well as subsequent setups, and further minimizing customization of the subsequent setups. Still further, the arrangement permits quick die change and installation. Also, the arrangement permits the transfer of a substantial amount of die setup time and labor to the die tryout room whereat the work can be done more accurately and efficiently.

These and many other important advantages of the invention will be further understood and appreciated by those skilled in the art by reference to the following written specification, claims, and appended drawings.

PRIOR ART

Figure 2:
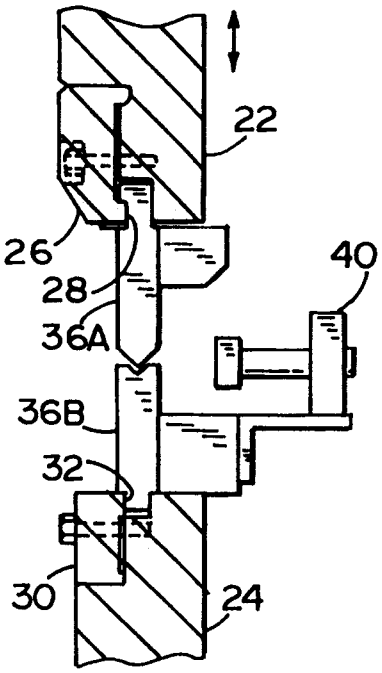
FIG. 2 PRIOR ART
FIGS. 1 and 2 are front and side views disclosing a brake press and brake die arrangement of prior art.
Figure 1:
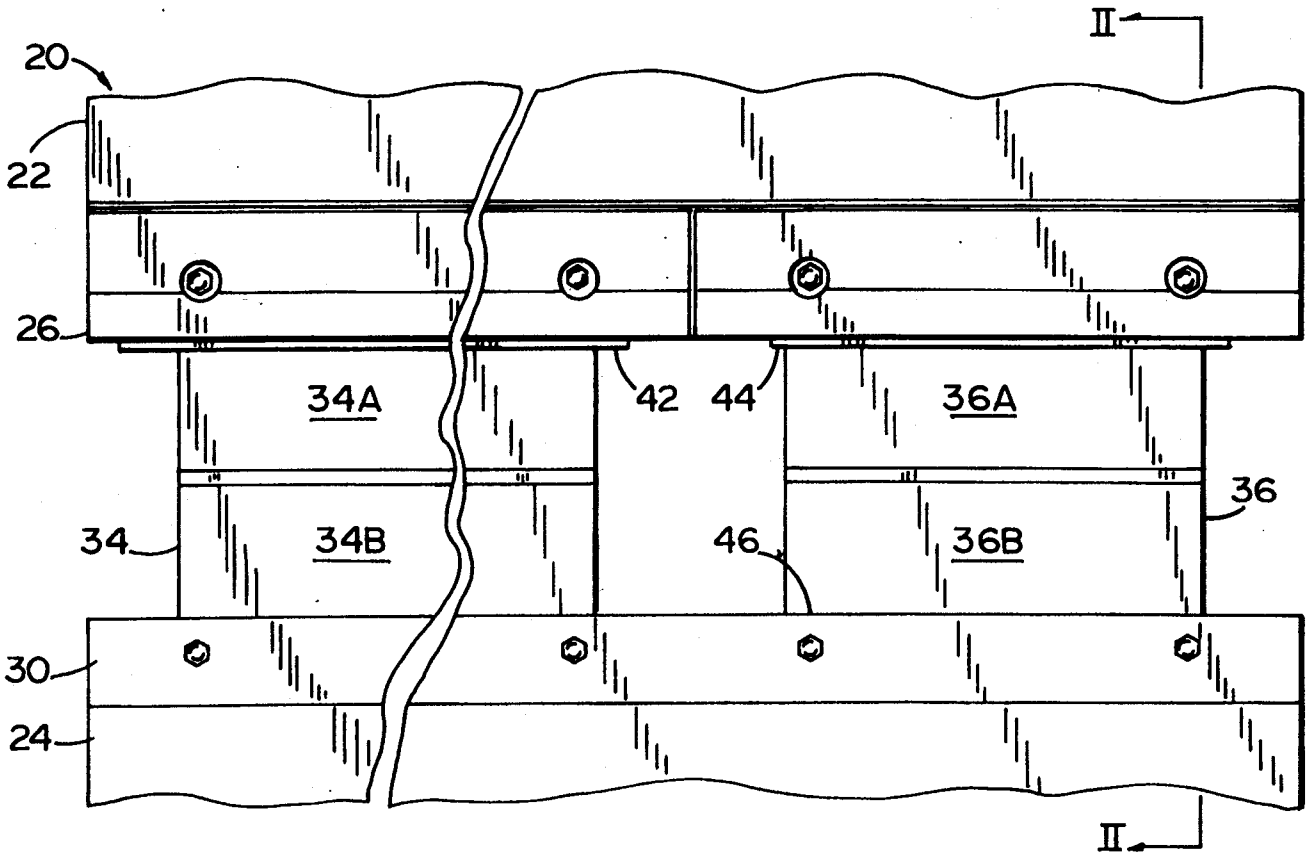
FIG. 1 PRIOR ART

In prior art, as shown in FIGS. 1 and 2, a brake press 20 includes a ram 22 and a stationary platen 24, ram 22 including an upper elongated jaw 26 with a hooked edge 28 and stationary platen 24 including a lower elongated jaw 30 with squared edge 32. Jaws 26 and 30 secure upper and lower mating die halves 34A, 34B, 36A and 36B of dies 34 and 36 to ram 22 and platen 24, respectively. Secondary equipment, such as equipment 40 is attached to the dies 34, 36 and platen 24 as desired. Shims such as thick shim 42 (FIG. 1), thin shim 44 and tab shim 46 are used as necessary to improve a balanced loading on the dies.

BRIEF DESCRIPTION OF THE PREFERRED EMBODIMENT

Figure 3:
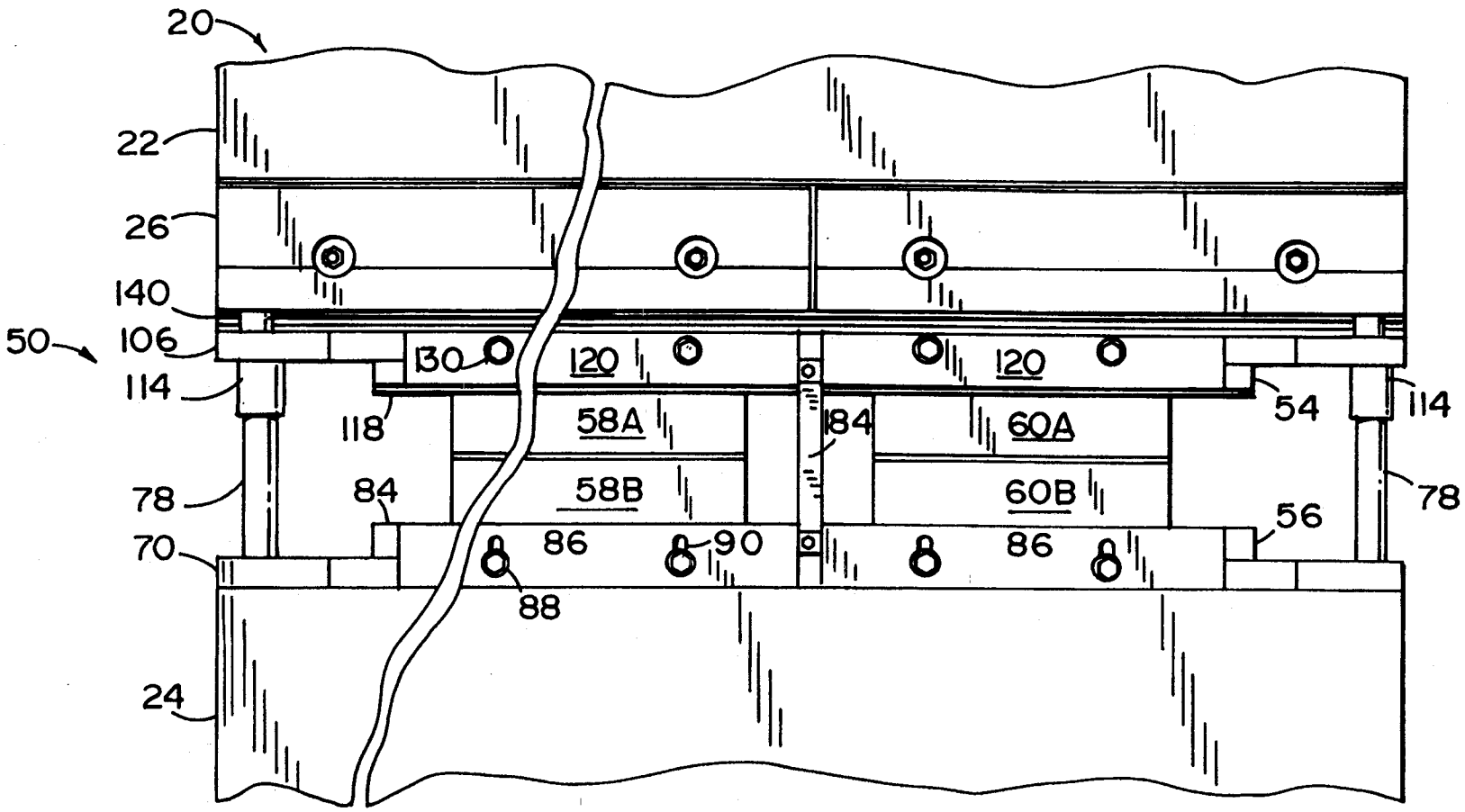
FIG. 3 is a fragmentary front view of a brake press apparatus embodying the present invention, shown installed in a brake press but before the tie-straps are removed.
Figure 4:
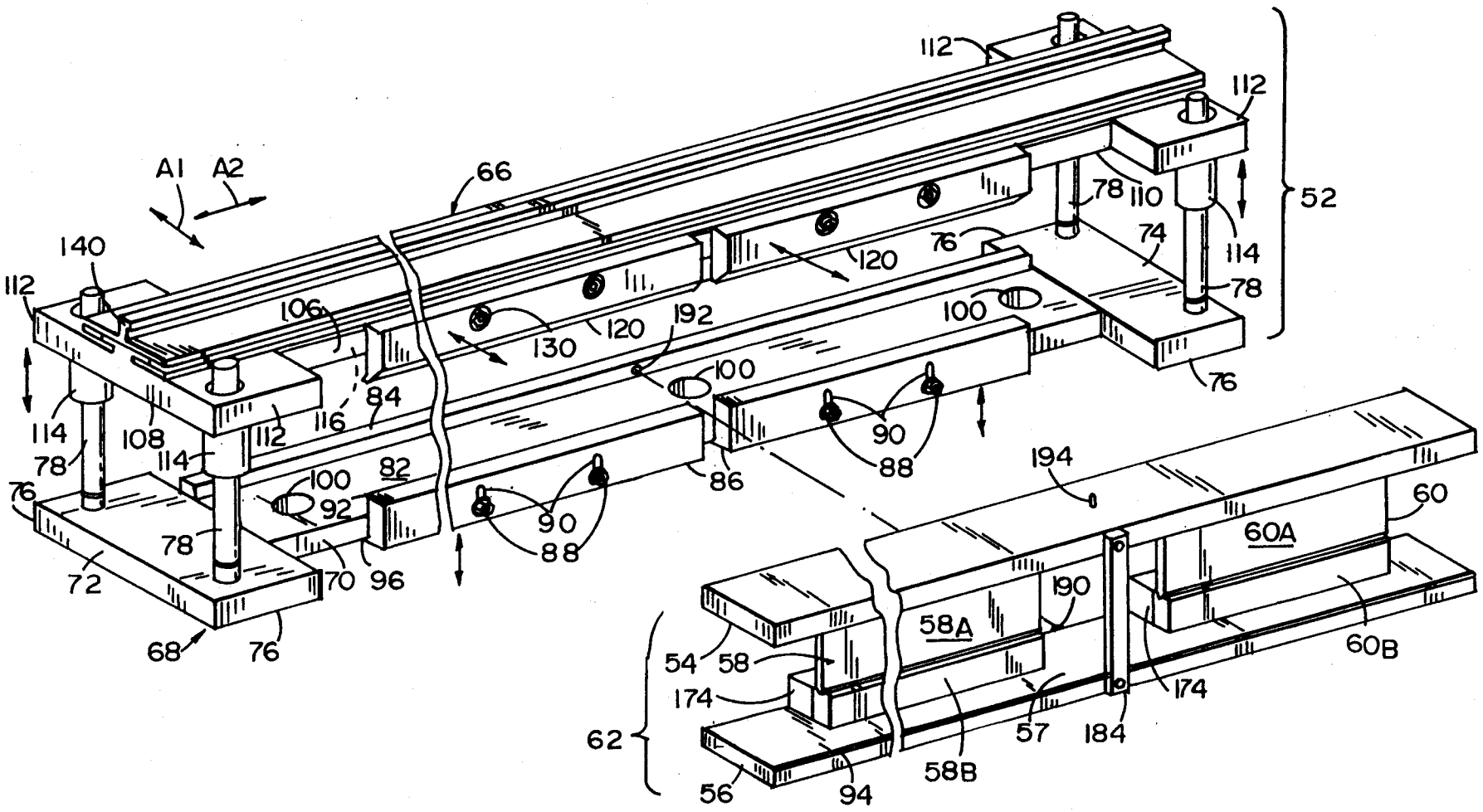
FIG. 4 is a fragmentary partially exploded perspective view of the apparatus in FIG. 3.

An apparatus for prealigning multiple brake dies to facilitate die changes in a brake press is illustrated in FIGS. 3–4 and is generally referred to as numeral 50. Apparatus 50 includes a die holder or die set 52 (FIG. 4) that can be operably and semipermanently mounted in a brake press 20, and further includes a pair of subplates 54 and 56 adapted to receive multiple brake dies such as dies 58 and 60 to form a semipermanent subassembly 62 that can be readily installed into die holder 52 with a minimum of on-site setup time and tools. Though only two dies are shown, three or more dies can be placed therein.

Apparatus 50 is particularly adapted for quick die changes where two or more brake dies must be setup in any one of several different production brake presses, such as in response to just-in-time production schedules. Further, apparatus 50, and in particular die holder 52, includes a floating adapter 140 that reduces undesired communication of bending stresses from ram 22 to die halves 58D, 58B, 60A and 60B of dies 58 and 60, respectively, thus reducing wear on dies 58, 60 and die holder 52 and improving die holder up efficiency and quality of parts produced.

Die set 52 (FIG. 4) includes an upper member portion 66 and lower member or portion 68. Lower member 68 comprises an elongate steel base plate 70 with ends 72 and 74, each end being enlarged crosswise to include laterally extending portions 76. A pair of guide pins 78 are fixedly secured to each end 72 and 74 in laterally extending portions 76, guide pins 78 extending upwardly therefrom. Plate 70 includes a finished planar support surface 82 for receiving subplate 56 of subassembly 62. Significantly, since guide pins 78 are spaced apart, subassembly 62 can be moved onto surface 82 from the front or side of press 20, depending of course upon the size of secondary equipment 186 which may prevent installation from a side.

Lower member 68 further includes an abutting member or plate 84 mounted to the rear side of steel base plate 70 and extending upwardly, and a set of lower clamps or jaws 86 operably mounted to the front side of steel base plate 70. Lower jaws 86 are mounted on bolts 88 that extend through vertical slots 90 in lower jaws 86. Bolts 88 can be loosened so that lower jaws 86 drop downwardly to a lowered position below finished upper surface 82 so that subassembly 62 can be installed therein. Alternately, jaws 86 can be held in a raised position where at bolts 88 can be tightened to secure lower subplate 66 therein against abutting plate 84. Lower jaws 86 include an upper angled lip 92 that engages an angled surface 94 on subplate 56, and also includes a square lip 96 that engages square channel 98 in steel base plate 70 (FIG. 6), thus causing jaw 86 to secure grip subplate 56 as bolts 88 are tightened.

Figure 5:
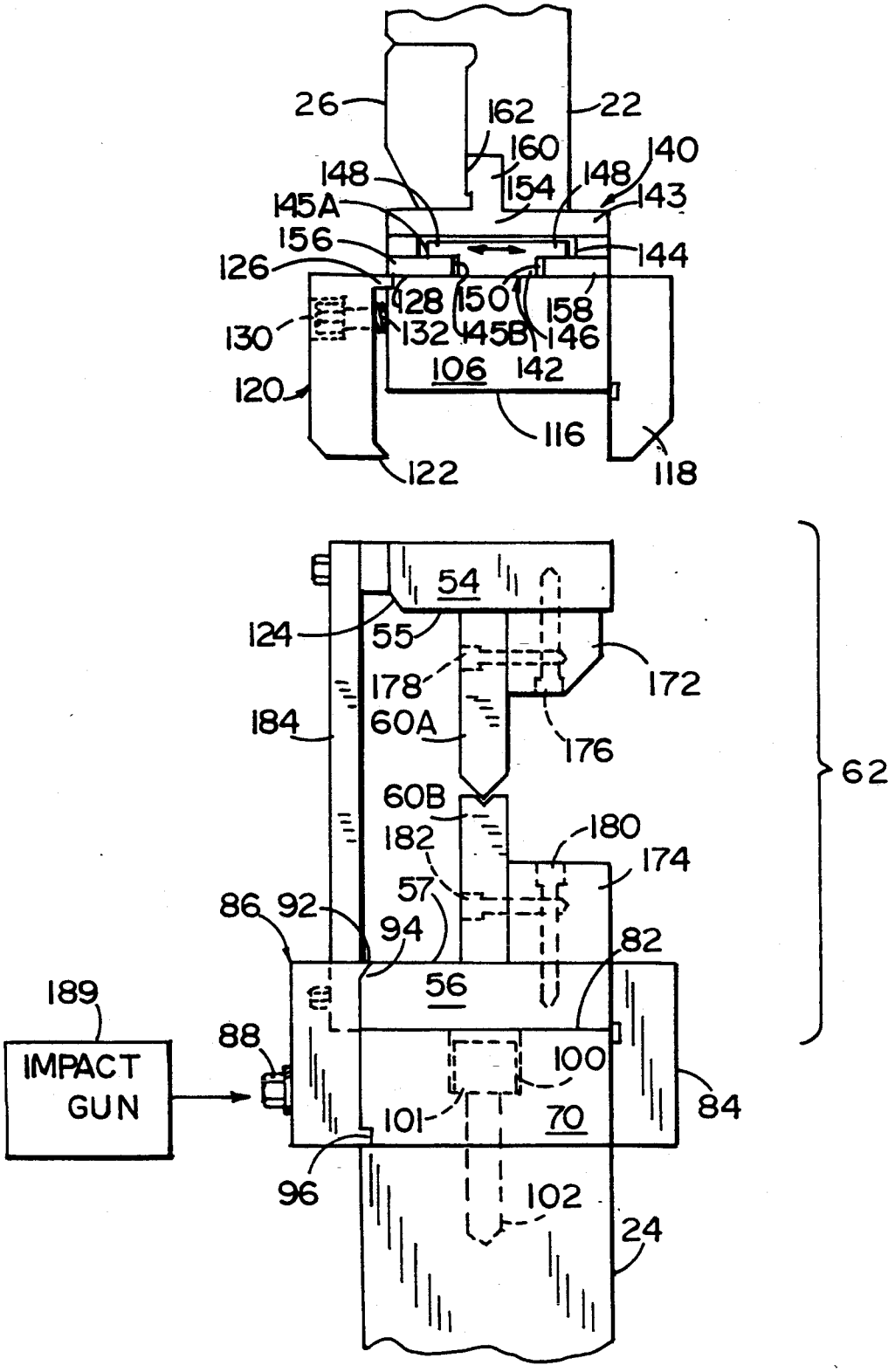
FIGS. 5–7 are side sectional views showing various stages during installation and setup of the apparatus of FIG. 3.

Holes 100 extend through plate 70 and include a lip 101 for receiving the head of a bolt 102 to retain die holder lower member 68 to stationary platen 24 of press 20 (FIG. 5). Bolt or screw 102 is contemplated to be a $\frac{5}{8}$" cap screw or the like. However, it is contemplated that different attachment means could be used as long as a secure arrangement is achieved.

Upper member 66 of die holder 52 includes an elongate steel top plate 106 corresponding to lower steel base plate 70. Top plate 106 includes ends 108 and 110, each end including laterally extending portions 112. Each laterally extending portions 112 includes an aperture with a linear bearing or bushing 114 secured therein for receiving a guide pin 78. Bearings 114 and guide pins 78 cooperate to guide subassembly 62 as it is closed, thus providing an improved linear path. Further, bearings 114 are more easily serviced, adjusted or replaced than bearings in press 20, thus providing a more convenient arrangement for maintenance or short term repair. Top plate 106 (FIG. 5) also includes a finished planar support surface 116 for receiving upper subplate 54, a rear mounted abutting member or plate 118, and upper jaws 120 for clampingly retaining upper subplate 54 against abutting plate 118 and to top plate 106. Upper jaws 120 are similar to lower jaws 86 in that they include a lower angled lip 122 for gripping an angled surface 124 on upper subplate 54, a square lip 126 for engaging a square channel 128 in top plate 106, and apertures for receiving bolts 130 to tighten upper jaws 120 against upper subplate 54. However, the bolt receiving apertures do not need to be slots. Rather, springs 132 are mounted on bolts 130 to bias jaws 120 outwardly when bolts 130 are loosened so that lip 122 does not strike the edge of subplate 54 as a new subassembly 62 is placed in press 20 and ram 22 is lowered onto same during setup (FIG. 5), as discussed below.

A floating adapter 140 (FIG. 5) is an elongate member that extends longitudinally the length of die holder 52 across the top of top plate 106. Floating adapter 140 includes a T-shaped member 142 and a jaw adapter 143 with T-shaped slot 144 therein, member 142 engaging slot 144 loosely such that members 142 and 143 can move in any direction relative to each other on a horizontal plane defined by the top of top plate 106. In the forward or rearward direction indicated by arrow "A1" (FIG. 4), floating adapter 140 permits relative movement of about an $\frac{1}{8}$ of an inch or more, depending upon the lateral clearance 145A and 145B (FIG. 5) designed into floating adapter 140. In the sideways direction indicated by arrow "A2" (FIG. 4), floating adapter 140 permits relative sliding movement that is substantially unrestricted. Thus, as ram 22 closes toward stationary platen 24, floating adapter 140 allows guide pins 78 to direct the closure of dies 58 and 60. This results in a more linear and true closure of dies 58 and 60. Thus, the non-uniform movement of ram 22 that normally creates undesirable bending forces that would normally be transmitted to dies 58 and 60, is substantially reduced. Further, guide pins 78 and bearings 114 are more easily maintained, further improving long term control, and reducing die refurbishing and press adjustments necessitated by the undesired bending forces.

T-shaped member 142 includes a stem 146 that is securely attached to the top plate 106, and laterally extending flanges 148 that form channels 150 thereunder on either side of stem 146. Jaw adapter 143 includes an adapter plate 154 with opposing fingers or claws 156 and 158 that extend downwardly and inwardly to matingly engage channels 150 and loosely grip T-shaped member 142. An elongated upright rib 160 with hook 162 extends upwardly from adapter plate 154. Rib 160 is adapted to be secured within upper jaw 26 to ram 22 of brake press 20.

Figure 6:
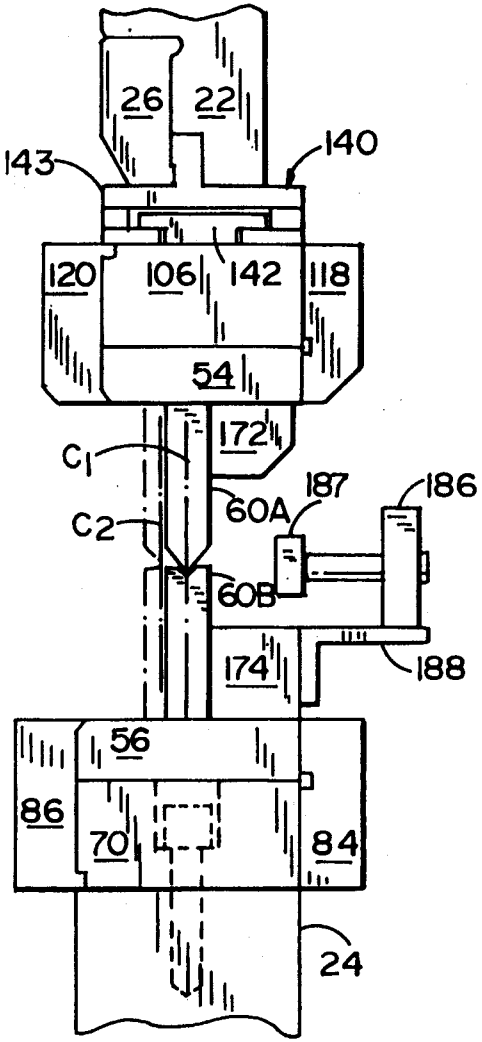

Subassembly 62 (FIG. 5) includes upper and lower subplates 54 and 56 with inwardly facing planar surfaces 55 and 57, respectively. Die halves 60A and 60B (and die halves 58A and 58B) are secured to same by abutting members or blocks 172 and 174 respectively, which are bolted in plate by multiple bolts 176, 178, 180 and 182. Notably, a number of different means for attaching die halves 168 and 170 to subplates 54 and 56 are contemplated, though only one means is shown. Subassembly 62 is held together as a unit by tie-straps 184 for transport and during the initial stages of installation and setup. Notably, secondary equipment 186 can be attached to abutting members 172 or 174, or directly to subplates 54 or 56, such as by a bracket 188 (FIG. 6). Secondary equipment 186 is contemplated to include gauges, air-blowouts, stops, shields, and the like necessary for safe and productive running of dies such as dies 58 and 60.

In the embodiment shown, dies 58 and 60 are aligned along a common center line "C1". However, it is contemplated that one of dies 58 and 60 could be shimmed forward to a different centerline such as centerline "C2" (FIG. 6), such as to facilitate optimal and efficient placement of dies 58 and 60 relative to each other and to secondary equipment 186. Further, it is contemplated that die halves 58A, 58B, 60A and 60B can be shimmed as necessary to create an optimum semipermanent subassembly 62.

A locater pin 190 (FIG. 4) extends laterally from the rear edge of subplate 56 and is adapted to engage socket 192 in abutting plate 84 to center subassembly 62 on die holder 52 during installation. A second locator pin 194 extends vertically upwardly for engaging a second socket (not shown) in finished lower surface 116 of top plate 106. Pin 194 locates upper subplate 54 on die holder 52, and prevents same from wandering on die holder 52 during operation of brake press 20.

Having described the interconnection and relationship of components, the operation of the present device will become apparent to one of ordinary skill in the art of brake presses. Initially, die halves 58A, 58B, 60A and 60B and of multiple break dies 58 and 60 are prepared for semipermanent mounting to abutting blocks 172 and 174 and to subplates 54 and 56 by bolts 176, 178, 180, and 182 to form subassembly 62. Subassembly 62 is then placed within a die tryout press which is usually optimally maintained for squareness and trueness of alignment whereat the die halves are shimmed, ground, packed or otherwise adjusted as needed. Notably, dies 58 and 60 can be positioned with different centerlines as may be desired for optimal placement on subplates 54 and 56. Secondary equipment 86 is also added as desired by brackets 188 and the like.

A die holder 52 is also installed in production brake press 20, die holder 52 being intended for semipermanent installation therein. Die set 52 is installed into press 20 with upper jaw 26 gripping upright rib 160 to ram 22, and bottom plate 70 being fastened to stationary platen 24 with screws 102 through holes 100 in plate 70. Die set 52 is shimmed as necessary to square die holder 52 in press 20. Significantly, after installation, as ram 22 is moved downwardly, T-shaped member 142 slides within T-shaped slot 144 in either direction "A1" or "A2" (FIG. 4) as necessary to adjust for nonlinear movement of ram 22. Thus, guide pins 88 control vertical alignment of top plate 106 and die halves 58A and 60A by bearins 114 as top plate 106 and die halves 58A and 60A move toward and away from bottom plate 70 and die halves 58B and 60B.

Subassembly 62 (FIG. 5) is then ready for installation into die holder 52 located in press 20. Subassembly can be slid laterally from a fork truck or cart (not shown) onto base plate 80 from either the side or front of brake press 20 in directions "A1" or "A2". Once in place, lower jaws 86 are lifted and tightened onto subplate 56 by using a tool such as an impact gun 189. Ram 22 is then carefully lowered until upper jaw 120 can similarly be secured onto top plate 106. Notably, tie-straps 184 slip into the space between adjacent of jaws 120 as shown in FIG. 3. Tie-straps 184 are then removed and all secondary equipment requiring compressed air or the like is connected (FIG. 6). Significantly, substantially the entire installation can be accomplished with only the use of an impact gun 189 to tighten the bolts to hold subassembly 62 in place in die holder 52. Further, quality parts can be made after only a very few hits or even on the first hit, thus substantially eliminating setup and start-up scrap.

Figure 7:
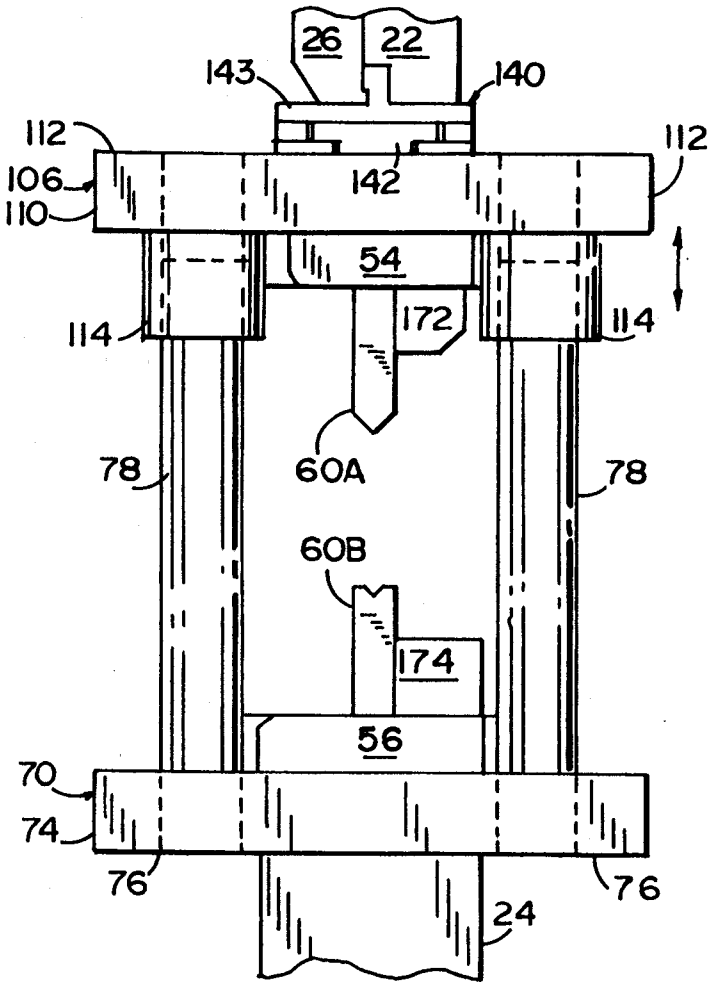

Once installed, ram 22 is then raised causing plate 106 and upper die half 168 to be lifted (FIG. 7). A part blank (not shown) is placed between die halves 168 and 170 against stop 187 of secondary equipment 186 (FIG. 6), and the die are repeatedly closed until a dimensionally acceptable part is formed. Due to the prealignment of die halves 168 and 170 in subassembly 62 and the prealignment of die holder 52 in press 20, dimensionally acceptable parts can typically be made after only a very few hits. It is contemplated that setups can be made in about 5 minutes using this arrangement, as opposed to previous methods requiring well over a half of an hour. In other words, the arrangement is substantially production ready after installation. Further, less training time is required to train persons that perform the installation, and less scrap is produced during setup. Still further, tool life is increased due to reduced communication of bending stresses to the die halves. This also results in less press tonnage being required, more consistent bends being formed, and overall quality being improved.

Thus, a brake press apparatus is provided including a die holder for installation in the brake, and a subassembly of prealigned dies attached to subplates connected by guides which are insertable into the die holder, the die holder being adapted with a floating adapter to permit the guides to control closing of the dies to improve efficiently of setup, quality of parts produced, and yet ease and reliability of installation. It will become apparent to those of ordinary skill in the art that various modifications to the preferred embodiment of the invention can be made without departing from the spirit or scope thereof as defined by the appended claims.

The embodiments of the invention in which an exclusive property or privilege is claimed as defined as follows:

1. An apparatus for prealigning one or more brake dies to facilitate die changes in a brake press having a ram, comprising:

a die holder including first means for operably mounting the same in the brake press, said first means including a floating adapter to minimize undesirable bending stresses on said die holder from misaligned and nonlinear movement of the ram of the brake press, said die holder further including a lower support surface; and a pair of subplates adapted to receive the brake dies in a semipermanent arrangement to form a subassembly wherein the brake dies can be prealigned, said subplates being adapted to mateably removably engage said die holder, said die holder including second means for securely retaining said subassembly therein and further including guide means for guiding said subplates along a linear path toward and away from each other, said second means including a lower jaw movable between a raised position and a lowered position, said lower jaw being below said lower support surface when said lower jaw is in said lowered position;

whereby the brake dies can be semipermanently attached to said subplates, said die holder can be semipermanently attached to the brake press, and said subassembly can be removably installed in said die holder in the brake press in a time efficient manner.

2. An apparatus as set forth in claim 1 wherein said die holder includes upper and lower jaws for retaining said subassembly in said die holder.

3. An apparatus as set forth in claim 2 wherein said upper jaw is movable between an engaged position for clampingly retaining said subassembly in said die holder and a disengaged position which provides clearance for installing said subassembly into said die holder, said upper jaw including a spring means for biasing said upper jaw outwardly to a position providing clearance as the ram is closed onto said subassembly during installation of said subassembly into said die holder.

4. An apparatus as set forth in claim 1 wherein said die holder includes a lower planar support surface for supporting one of said pair of subplates on said subassembly, said lower planar support surface permitting insertion of said subassembly into the brake press from the front or side of the brake press.

5. An apparatus as set forth in claim 1 wherein said subplates and said die holder include a locator pin and socket arrangement to locate said subplates in said die holder.

6. An apparatus as set forth in claim 1 wherein said floating adapter is adapted to attach to the ram.

7. An apparatus as set forth in claim 6 wherein said floating adapter includes an upper member and a lower member, one of said upper member and said lower member including a T-shaped slot, and the other of said upper member and said lower member including a T-shaped member shaped to operably engage said T-shaped slot and laterally float therein so that forces can be communicated from the ram vertically to the brake dies while minimizing the transfer of undesirable bending stresses therethrough.

8. An apparatus as set forth in claim 7 wherein said T-shaped slot extends the length of said die holder.

9. An apparatus as set forth in claim 1 wherein one or more brake dies include at least two brake dies each defining a centerline, and said pair of subplates are adapted to receive the brake dies with at least one of the centerlines nonaligned with the remaining centerlines of the brake dies.

10. An apparatus as set forth in claim 1 wherein said subplates include substantially planar support surfaces for receiving and supporting the brake dies.

11. An apparatus as set forth in claim 1 wherein said subplates include an abutting member and a means for attaching said brake dies to said abutting member and in turn to said subplates.

12. An apparatus as set forth in claim 11 wherein said abutting member provides a mounting surface for attaching secondary equipment for the brake dies.

13. An apparatus as set forth in claim 1 wherein said subplates include a mounting surface adapted so that secondary equipment can be mounted thereto, the secondary equipment being useful to facilitate use of the brake dies.

14. An apparatus for prealigning one or more brake dies to facilitate die changes in a brake press having a ram, comprising:

a die holder including first means for operably mounting the same in the brake press, said first means including a floating adapter to minimize undesirable bending stresses on said die holder from misaligned and nonlinear movement of the ram of the brake press;

a pair of subplates adapted to receive the brake dies in a semipermanent arrangement to form a subassembly wherein the brake dies can be prealigned, said subplates being adapted to mateably removably engage said die holder, said die holder including second means for securely retaining said subassembly therein and further including guide means for guiding said subplates along a linear path toward and away from each other;

said die holder including upper and lower jaws for retaining said subassembly in said die holder;

said lower jaw being movable between a raised position for clamplingly retaining said subassembly in said die holder and a lowered position which provides clearance for inserting said subassembly horizontally into said die holder over said lower jaw, said lower jaw including slots permitting the movement between said raised position and said lowered position; and whereby the brake dies can be semipermanently attached to said subplates, said die holder can be semipermanently attached to the brake press, and said subassembly can be removably installed in said die holder in the brake press in a time efficient manner.

15. An apparatus for prealigning one or more brake dies to facilitate die changes in a brake press having a ram, comprising:

a die holder including first means for operably mounting the same in the brake press, said first means including a floating adapter to minimize undesirable bending stresses on said die holder from misaligned and nonlinear movement of the ram of the brake press;

a pair of subplates adapted to receive the brake dies in a semipermanent arrangement to form a subassembly wherein the brake dies can be prealigned, said subplates being adapted to mateably removably engage said die holder, said die holder including second means for securely retaining said subassembly therein and further including guide means for guiding said subplates along a linear path toward and away from each other;

said die holder including a lower planar support surface for supporting one of said pair of subplates on said subassembly, said lower planar support surface permitting insertion of said subassembly into the brake press from the front or side of the brake press;

said second means including a lower jaw movable between a raised position and a lowered position, said lower jaw being below said lower planar support surface when said lower jaw is in said lowered position; and whereby the brake dies can be semipermanently attached to said subplates, said die holder can be semipermanently attached to the brake press, and said subassembly can be removably installed in said die holder in the brake press in a time efficient manner.

16. An apparatus for prealigning multiple brake dies to facilitate die changes in a brake press having a ram, the multiple brake dies each defining a centerline, comprising:

a die holder including means for mounting the same in the brake press; and a pair of subplates adapted to receive the multiple brake dies in a semipermanent arrangement to form a subassembly wherein the multiple brake dies can be prearranged in a production ready condition;

said die holder including a lower support surface for receiving said pair of subplates adapted so that said subassembly can be received from the front or side of the brake press; and said die holder including jaws for securely retaining said subassembly therein including a lower jaw movable between a raised position and a lowered position, said lower jaw being below said lower support surface when in said lowered position, whereby the multiple brake dies can be semipermanently attached to said subplates, said die holder can be semipermanently attached to the brake press, and said subassembly can be removably installed in said die holder in the brake press in a time efficient manner with reduced setup time.

17. An apparatus as set forth in claim 16 wherein said support surfaces are planar so that at least one of the multiple brake dies can be arranged on said subplates with the centerline of the one multiple brake die offset from the centerline of the other multiple brake dies.

18. An apparatus as set forth in claim 16 wherein said subplates include an abutting member and a means for attaching each of the multiple brake dies to said abutting member and in turn to said subplates.

19. An apparatus as set forth in claim 18 wherein said subplates provide a mounting surface for attaching secondary equipment thereto, the secondary equipment being useful when operating the multiple brake dies.

20. A method for prealigning multiple brake dies to facilitate die change, comprising:

providing a die holder adapted to be mounted in a brake press and a pair of subplates adapted to be removably mounted in said die holder, said die holder including a floating adapter adapted to operably connect to a movable ram on the brake press, a lower support surface for supporting one of said pair of subplates, and a lower jaw for securing said one subplate to said die holder;

attaching said die holder in the brake press so that said floating adapter allows said die holder to laterally float relative to the ram thereby allowing said die holder to remain in alignment during closure of the brake press and to minimize communication of undesired stresses therethrough;

prealigning said multiple brake dies in said pair of subplates to form a subassembly;

lowering said lower jaw below said lower support surface to facilitate said support surface receiving said subassembly;

positioning said subassembly on said lower support surface; and removably mounting said subassembly to said die holder in the brake press including clamping said one subplate with said lower jaw to thus provide an arrangement that minimizes brake press down time during die changes.

21. A method as set forth in claim 20 including providing tie straps, attaching said tie straps to said pair of subplates to secure same together with the multiple brake dies held therebetween, and removing said subplates and the multiple brake dies from the brake press as a unit.

22. A method as set forth in claim 20 including securing said subassembly to said die holder in a production-ready state by use of an impact gun without the need for additional tools.

* * * * *

UNITED STATES PATENT AND TRADEMARK OFFICE

CERTIFICATE OF CORRECTION

PATENT NO. : 5,365,767

DATED : November 22, 1994

INVENTOR(S) : William A. Kitchen et al.

It is certified that error appears in the above-indentified patent and that said Letters Patent is hereby corrected as shown below:

Column 6, line 30;
"as defined" should be --are defined--.

Column 8, line 4, claim 14;
"clamplingly" should be --clampingly--.

Signed and Sealed this

Eighth Day of August, 1995

*Attest:*

*Attesting Officer*

BRUCE LEHMAN

*Commissioner of Patents and Trademarks*